United States Patent [19]

Hereth

[11] 4,074,611

[45] Feb. 21, 1978

[54] FLUID PRESSURE ACTUATOR FOR PRODUCING ROTATIONAL MOTION

[76] Inventor: Ralph F. Hereth, 3608 Clover Valley Road, Port Orchard, Wash. 98366

[21] Appl. No.: 663,569

[22] Filed: Mar. 3, 1976

Related U.S. Application Data

[63] Continuation-in-part of Ser. No. 500,447, Aug. 26, 1974, abandoned.

[51] Int. Cl.[2] ..... F01B 9/00; F01L 25/08; F01L 33/04

[52] U.S. Cl. ..... 91/179; 91/186; 91/275; 92/137; 92/68

[58] Field of Search ..... 91/186, 417 R, 275, 91/321, 179; 92/68, 137

[56] References Cited

U.S. PATENT DOCUMENTS

| | | | |
|---|---|---|---|
| 204,828 | 6/1878 | Jenkins | 91/186 |
| 2,668,450 | 2/1954 | Crookston et al. | 92/68 |
| 2,875,734 | 3/1959 | Winters et al. | 91/417 R |
| 3,030,931 | 4/1962 | Baxter et al. | 91/186 |

FOREIGN PATENT DOCUMENTS

| | | | |
|---|---|---|---|
| 1,115,033 | 12/1955 | France | 92/137 |
| 1,386,572 | 7/1975 | United Kingdom | 92/68 |

*Primary Examiner*—Paul E. Maslousky

[57] ABSTRACT

The actuator includes two piston motors interconnected in opposed driving relation with a fixed axis rotary shaft, and fluid pressure control means for controlling the piston motors so that they rotate the shaft bi-directionally at constant rotational velocity with constant resultant torque. The two piston motors preferably are of different effective cross sectional areas, the smaller motor being continuously pressurized with fluid composed solely of fluid from a fluid pressure source, and the larger motor being selectively pressurized with fluid made up of fluid from the fluid pressure source together with fluid exhausted from the smaller motor. A single valve controls fluid flow to and from the piston motors to effect bi-directional shaft rotation, or maintain the shaft in a fixed position. The valve may be operated automatically by servo control means responsive to the positions of the piston motors.

12 Claims, 3 Drawing Figures

FLUID PRESSURE ACTUATOR FOR PRODUCING ROTATIONAL MOTION

CROSS REFERENCE TO RELATED APPLICATION

This application is a continuation-in-part of application Ser. No. 500,447, filed Aug. 26, 1974 now abandoned.

BACKGROUND OF THE INVENTION

1. Field of the Invention

This invention relates to fluid pressure operated actuators for producing rotational motion for such purposes as rotary valve operation for example.

2. Description of the Prior Art

Fluid pressure operated actuators for producing rotational motion are generally well known in the prior art wherein it is customary to mechanically interconnect a plurality of pressure operated cylinder-mounted pistons with a rotatable output shaft such as illustrated in U.S. Pat. Nos. 3,153,317 to Manor et al and 3,099,287 to Manor. In the systems disclosed in these patents, the mechanical interconnection between the pistons and output shaft takes the form of a flexible band or rigid shaft wherein bi-directional linear movement of the pistons causes bi-directional rotation of the output shaft. While useful for the purposes disclosed, these systems tend to be physically bulky and require complicated fluid control circuits. More particularly, the mechanical linkage systems disclosed in the noted patents to manor and Manor et al require the cylinder-mounted pistons to travel a distance equal to the circumferential distance traveled by the rotatable output shaft due to the direct mechanical linkage therebetween.

Some flexibility has been achieved in the prior art by use of chain linkage systems providing double runs for each pressure operated piston, such as disclosed in U.S. Pat. No. 2,449,269 to Austin, FIG. 3. The system disclosed in the Austin patent converts the linear displacement of the cylinder pistons into linear displacement of an output member but does not disclose a system wherein the required length of the operating cylinders may be decreased while maintaining the same capability for rotational displacement of an output shaft having a fixed axis of rotation. The piston arrangement and fluid valving system of Austin is also incapable of producing reversible rotary motion such as contemplated by the present invention.

Another disadvantage of the fluid control systems for actuators of the type disclosed in the patents to Manor and Manor et al. has been the use of complicated reversing valves which are designed to supply and exhaust fluid pressure to and from every cylinder in the system through passages provided in the reversing valve itself. It is known in certain types of spool valve operating systems, such as disclosed in U.S. Pat. No. 3,596,560 to Butterworth for example, to supply constant pressure to one face of a double acting piston (valve spool) while selectively pressurizing the exhausting fluid pressure to an opposing face of the piston which is of larger effective cross-sectional area. However, no arrangement such as disclosed in the Butterworth patent has been employed in a pressure operated actuator having a pair of pressure operated, cylinder-mounted pistons mechanically linked with an output shaft adapted to rotate about a fixed axis.

SUMMARY OF THE INVENTION

It is the primary object of this invention to provide a fluid pressure operated actuator which is adapted to overcome the disadvantages of the prior art. More particularly, this invention is directed to a fluid pressure operated actuator having a compact size and simplified control system compared with systems known heretofore.

Another object of this invention is to provide a fluid pressure operated actuator which includes a pair of piston motors adapted to rotate an output shaft bi-directionally, and fluid pressure control means including a single valve for continuously pressuring one piston motor while selectively pressuring the other piston motor with fluid exhausted from the one piston motor.

Yet another object of the invention is to provide an actuator of the type described with a fluid flow rate control means in the fluid pressure control means for controlling the rate of fluid flow to and from the piston motors so that the output shaft will be rotated at constant and equal rotational velocity in both directions of rotation.

A related object is to provide a fluid pressure source in the fluid pressure control means for controlling the fluid pressures applied to the piston motors in relation to the effective cross sectional areas thereof such that the resultant force applied to the output shaft causes it to rotate at constant torque in both directions of rotation. While preferably, the effective piston cross sectional areas are in a 2:1 ratio and the fluid pressures applied thereto are equal, other piston constructions and correlated fluid pressures may be used, if desired.

Another object of the subject invention is to provide a check valve between the supply of fluid pressure and the smaller piston motor whereby the smaller piston motor may be held in a fixed position when the control valve is moved to a selected position, thereby insuring that the output shaft is held in a fixed position.

Still another object of the subject invention is to provide a pair of position sensors for sensing the position of the piston motors and a servo control means for automatically moving the control valve upon receipt of signals from the sensors.

The means by which the foregoing objects and other advantages, which will be apparent to those skilled in the art, are accomplished are set forth in the following specification and claims and illustrated in the accompanying drawings.

DESCRIPTION OF THE PREFERRED EMBODIMENT

Figure 1:
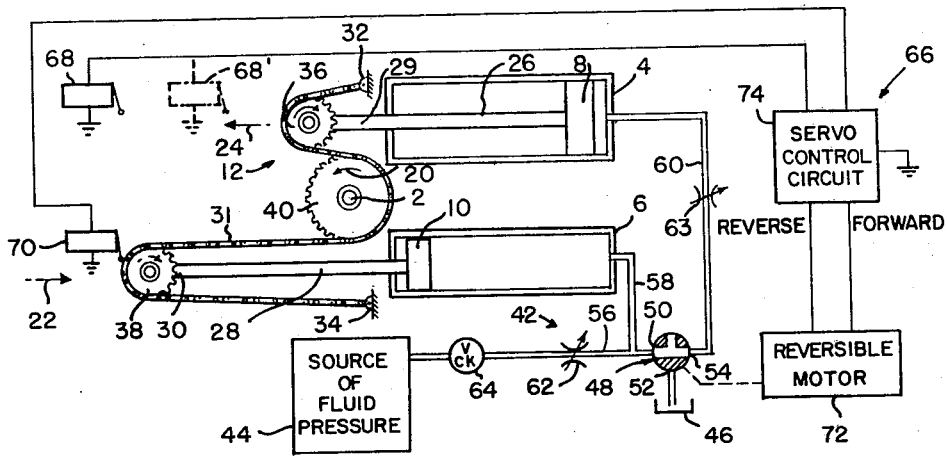
FIG. 1 is a schematic illustration of the fluid pressure operated actuator in accordance with the subject invention.

Referring to FIG. 1, a fluid pressure operated actuator for producing rotational motion is illustrated including an output shaft 2 mounted for rotation about a fixed axis coincident with the longitudinal axis of the output shaft and a pair of fluid pressure operated cylinders 4 and 6. Mounted for advancement and retraction respectively within the cylinders 4 and 6 are pistons 8 and 10. For purposes which will be more fully explained subsequently, piston 10 in the preferred embodiment has a cross-sectional area which is one-half that of piston 8.

A linkage means generally indicated by the numeral 12 mechanically interconnects output shaft 2 and pistons 8 and 10 to cause the output shaft to rotate in a first direction (arrow 14, FIG. 2) and piston 8 to retract (arrow 16) when piston 10 is advanced (arrow 18) under fluid pressure. Similarly, the linkage means causes the output shaft 2 to rotate in a second direction (arrow 20, FIG. 1) opposite the direction illustrated by arrow 14 and causes piston 10 to retract (arrow 22) when piston 8 is advanced (arrow 24) under fluid pressure.

Figure 2:
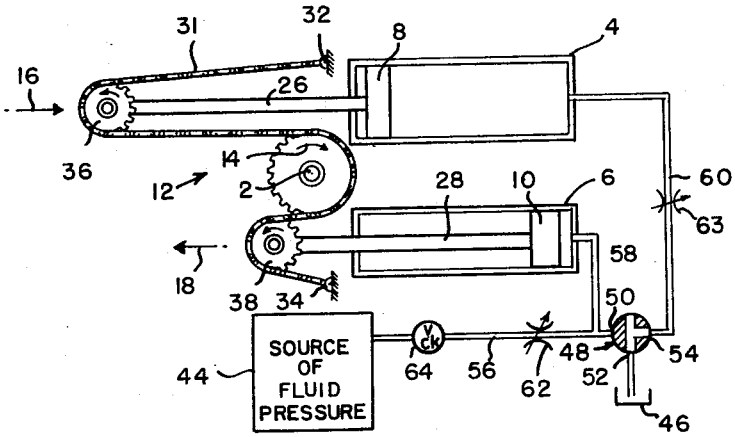
FIG. 2 is a schematic illustration of the actuator in FIG. 1 wherein the actuator is illustrated as operating in a direction opposite to the direction of operation in FIG. 1.

The linkage means includes piston rods 26 and 28 connected, respectively, with pistons 8 and 10. As illustrated in FIGS. 1 and 2, one end, 29 and 30, of each piston rod (26 and 28 respectively) extends outside the associated cylinder. An elongated flexible non-extensible linkage element 31 is entrained around the outside ends 29 and 30 of the piston rods and around the rotatable shaft 2. The linkage element 31 is held at each end 32 and 34 to a fixed position relative to the fixed axis of rotation of the output shaft 2. As illustrated in FIG. 1, the linkage means 31 further includes toothed sprockets 36 and 38 rotatively connected with the outside ends 29 and 30 of piston rods 26 and 28, respectively, and toothed sprocket 40 connected to output shaft 2 for rotation therewith. In the specific embodiment illustrated in FIG. 1, the elongated flexible non-extensible linkage element 31 takes the form of a link chain although any other type of flexible non-extensible element may be used such as a bank, rope or cable.

Figure 3:
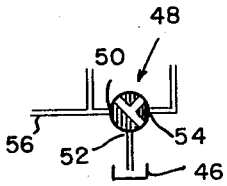
FIG. 3 is a schematic illustration of the actuator control valve moved to a system locking position.

The fluid pressure operated actuator illustrated in FIG. 1 further includes a fluid pressure control means (indicated generally by arrow 42) for continuously applying fluid pressure to cylinder 6 and for selectively applying fluid pressure to and relieving fluid pressure from cylinder 4, whereby the output shaft is adapted to rotate in direction 14 when fluid pressure is relieved from cylinder 4 and the output shaft 2 is adapted to rotate in direction 20 when fluid pressure is applied to cylinder 4. The fluid pressure control means includes a fluid pressure source 44, a fluid sump 46 and a three position control valve 48. The control valve 48 includes an inlet port 50 connected with the fluid pressure source 44, an outlet port 52 connected with the fluid sump 46 and a working port 54 connected with cylinder 4, wherein the inlet port 50 and the working port 54 are interconnected and the exhaust port 52 is closed when the valve 48 is in the first position (FIG. 1). When the valve is moved to the second position, illustrated in FIG. 2, the inlet port 50 is closed and the working port 54 and exhaust port 52 are interconnected. Finally, as illustrated in FIG. 3, all ports of valve 48 are closed when the valve is moved to the third position.

The fluid pressure control means 42 further includes a fluid circuit having a first conduit 56 extending between the fluid pressure source 44 and the inlet port 50, a second conduit 58 extending between the first conduit 56 and cylinder 6 and a third conduit 60 extending between the working port 54 and the cylinder 4. A flow rate control means 62 is provided within the first conduit 56 between the fluid pressure source 44 and the second conduit 58 for supplying fluid flow to cylinders 4 and 6 at constant fluid velocity. A second flow rate control means 63 provided in conduit 60 maintains constant fluid velocity both to and from cylinder 4.

Flow rate control means 62 and 63 may be fixed orifice type fluid flow rate control devices, the orifice size being selectively adjustable to control fluid flow rate, as desired. The fluid flow control means 62 also includes a check valve 64 located between the fluid pressure source 44 and second conduit 58 to thereby prevent reverse flow in conduit 56 when the control valve is moved to the third position. Thus, the check valve assures that piston 10 is held in a locked position at the same time that piston 8 is prevented from displacement in either direction by control valve 48.

While control valve 48 may be manually controlled, the subject actuator may also be completely automated by a simplified control system as illustrated in FIG. 1. More particularly, FIG. 1 discloses a servo control means 66 for automatically moving control valve 48 between first, second and third positions upon receipt of predetermined control signals derived from position sensors 68 and 70 connected with the servo control means 66 for sensing the position of pistons 8 and 10, respectively. The servo control means 66 includes a reversible motor 72 mechanically connected with the control valve 48, as depicted by the broken line, and a servo control circuit 74 connected with the reversible motor and adapted to control motor 72 in response to signals received from sensors 68 and 70. As illustrated in FIG. 1, the position sensors 68 and 70 may be adjusted to other positions such as illustrated by 68' to determine the end travel of the associated piston and thereby control the angular displacement in each direction of the output shaft.

The operation of the disclosed fluid pressure operated actuator should now be apparent from the above description and drawings. Shaft 2 is rotated bi-directionally under the control of single control valve 48. When the pistons are positioned as indicated in FIG. 1, and control valve 48 is in the first position, fluid pressure is applied simultaneously to cylinders 4 and 6 through conduits 56, 58 and 60. Since piston 8 has an effective area larger than piston 10, piston 8 and piston rod 26 are caused to advance in the direction indicated by arrow 24, to thereby cause counter-clockwise rotation, arrow 20, of sprocket 40 and output shaft 2. Upon reaching the desired end of travel of piston 8, control valve 48 is either manually or automatically moved to the position indicated in FIG. 2 to thereby exhaust fluid pressure from cylinder 4 while maintaining fluid pressurization of cylinder 6. This condition of the actuator causes piston 10 to advance in the direction of arrow 18, thereby reversing rotation of output shaft 2 and causing retraction of cylinder 8 in the direction of arrow 16.

Shaft 2 further is rotated at constant and equal rotational velocity and torque. Constant velocity shaft rotation is accomplished by flow rate control means 62 and 63 which maintain constant fluid flow rate to and from cylinders 4 and 6. During clockwise shaft rotation (see FIG. 2), control means 62 maintains constant velocity fluid flow to cylinder 6 while control means 63 maintains constant velocity fluid flow from cylinder 4 to sump. Likewise, during counter-clockwise shaft rotation (FIG. 1), they maintain constant velocity fluid flow to cylinder 4 and from cylinder 6 — fluid supplied to cylinder 4 being made up of fluid from source 44 and fluid exhausted from cylinder 6. Constant and equal shaft torque is accomplished in the illustrated fluid system by applying equal fluid pressure from source 44 to pistons 8 and 10, the effective cross-sectional area of which are in a 2:1 ratio so that the resultant force applied to shaft 2 remains constant and equal. It will be recognized, of course, that pistons 8 and 10 could be of different effective areas and, hence, the pressures applied may be unequal, provided the pressures applied are related to the effective piston areas such that the resultant driving torque applied to shaft 2 is constant and equal in both directions of shaft rotation. Either construction, of course, also provides equal shaft velocity in both directions of shaft rotation.

If it is desired to lock output shaft 2 in a selected position, control valve 48 is first operated to place the shaft in the desired position and thereafter control valve 48 is moved to the position illustrated in FIG. 3 wherein pot 54 is closed, thereby trapping fluid within cylinder 4 and locking piston rod 26 in a fixed position. By virtue of check valve 64 located in conduit 56 and by virtue of the closing of port 50 by the control valve 48, fluid is also trapped in cylinder 6 thereby also locking piston rod 28 in a fixed position. Clearly with both pistons 8 and 10 held in a fixed position, shaft 2 is prevented from moving in either direction of rotation.

The disclosed fluid pressure operated actuator achieves numerous advantages over actuators known heretofore. For example, the linkage means produces a more compact design by employing an elongated flexible non-extensible linkage element fixed at each end relative to the fixed axis of rotation of the output shaft. More particularly, the linkage element is entrained around the outside ends of each piston rod and around the output shaft, thereby permitting a compact arrangement wherein a point on the periphery of sprocket 40 connecting the chain 30 to the output shaft is caused to move twice the distance of displacement of either pistons 8 or 10 during rotational displacement of shaft 2. Accordingly, cylinders 4 and 6 may be shortened in length without decreasing the total possible angular displacement of the output shaft 2. Moreover, by providing piston 8 with a larger effective area than piston 10, a simplified valve control system may be employed wherein piston 10 remains pressurized at all times and the output shaft 2 may be rotated in opposite directions merely by supplying or exhausting fluid pressure from a single cylinder.

By adding check valve 64 to line 56, the possibility of slack in the system is prevented at all times whether the output shaft is being rotated or held in a fixed position.

The fluid pressure control means may be further improved by utilizing a cushion valve to avoid high accelerations or decelerations of fluid which may otherwise result in damaged mechanical parts.

The embodiments of the invention in which an exclusive property or privilege is claimed are defined as follows:

1. A fluid pressure actuator for producing bidirectional rotational motion of a rotary shaft, comprising: first and second fluid pressure operated piston motors, said second piston motor having a larger effective cross-sectional area than said first piston motor, each adapted to exert a driving force in response to application of fluid pressure thereto; linkage means interconnecting said piston motors to the shaft for transmitting their respective driving forces to the shaft in opposed relation, so as to cause alternate reversing rotation thereof upon alternate advancement and retraction of said piston motors; and fluid pressure control means including a fluid pressure source arranged to supply constant fluid pressure to said first piston motor, a fluid pressure return, and a single control valve connected with said fluid pressure source, said fluid pressure return and said first and second piston motors and including means for (1) maintaining fluid pressure on said first piston motor composed solely of fluid from said fluid pressure source while exhausting fluid from said second piston motor to said fluid return, thereby causing said rotary shaft to rotate in a first direction, and for (2) connecting said second piston motor to said source of fluid pressure and said first piston motor while blocking both said piston motors from said fluid pressure return, thereby causing said rotary shaft to rotate in a second direction opposite said first direction.

2. The actuator of claim 1, wherein, said fluid pressure control means include means for maintaining a constant rate of fluid flow to and from said first and second piston motors.

3. The actuator of claim 1, wherein said fluid pressure control means are further operable to supply fluid at pressures related to the effective cross-sectional areas of said first and second piston motors such that the driving force exerted by said second piston motor is greater than the driving force exerted by said first piston motor.

4. The actuator of claim 1, wherein said fluid pressure control means include (1) means for controlling the rate of fluid flow such that the shaft may be rotated at substantially constant rotational velocity in said first and second directions of rotation, and (2) means for controlling fluid pressure in relation to the effective cross-sectional areas of said first and second piston motors such that the driving force exerted by said second piston motor is greater than the driving force exerted by said first piston motor while the resultant driving force applied to said shaft by said first and second piston motors is maintained substantially constant in both directions of shaft rotation.

5. The actuator of claim 1, wherein said first piston motor has an effective cross-sectional area one half the effective cross-sectional area of said second piston motor, and wherein said first and second piston motors respectively include first and second pistons and first and second cylinders.

6. A fluid pressure actuator for producing bidirectional rotational motion of a rotary shaft, comprising: first and second fluid pressure operated piston motors, including first and second pistons and first and second cylinders, respectively, each piston motor adapted to exert a driving force in response to application of fluid pressure thereto, said first piston motor having an effective cross-sectional area one half the effective cross-sectional area of said second piston motor; linkage means interconnecting said piston motors to the shaft for transmitting their respective driving forces to the shaft in opposed relation, so as to cause alternate reversing rotation thereof upon alternative advancement and retraction of said piston motors, said linkage means including first and second piston rods connected to and adapted to move with said first and second pistons, respectively, each said piston rod having one end extending outside said associated cylinder, and an elongated flexible non-extensible linkage element entrained around said outside ends of said piston rods and around said rotary shaft, said linkage element being held fixed at each end relative to said fixed axis of rotation of said rotary shaft; and fluid pressure control means including a fluid pressure source, a fluid pressure return and a single control valve for (1) supplying fluid to said first piston motor composed solely of fluid from said fluid pressure source while exhausting fluid from said second piston motor to said fluid return, thereby causing said rotary shaft to rotate in a first direction, and for (2) supplying fluid to said second piston motor composed of fluid from said fluid pressure source and fluid exhausted from said first piston motor, thereby causing said rotary shaft to rotate in a second direction opposite said first direction.

7. The actuator of claim 6, wherein said linkage means further includes first and second toothed sprockets rotatively connected with the outside ends of said first and second piston rods, respectively, and a third toothed sprocket connected to said output shaft for rotation therewith, and wherein said linkage element includes a link chain engaging said first, second and third sprockets.

8. A fluid pressure actuator for producing bidirectional rotational motion of a rotary shaft, comprising: first and second fluid pressure operated piston motors, each adapted to exert a driving force in response to application of fluid pressure thereto; linkage means interconnecting said piston motors to the shaft for transmitting their respective driving forces to the shaft in opposed relation, so as to cause alternate reversing rotation thereof upon alternative advancement and retraction of said piston motors; and fluid pressure control means including a fluid pressure source, a fluid pressure return, and a single control valve for (1) supplying fluid to said first piston motor composed solely of fluid from said fluid pressure source while exhausting fluid from said second piston motor to said fluid return, thereby causing said rotary shaft to rotate in a first direction, and for (2) supplying fluid to said second piston motor composed of fluid from said fluid pressure source and fluid exhausted from said first piston motor, thereby causing said rotary shaft to rotate in a second direction opposite said first direction, said control valve including an inlet port connected with said fluid pressure source, an exhaust port connected with said fluid return, and a working port connected with said second piston motor, and wherein said inlet and working ports are interconnected and said exhaust port is closed when said control valve is in a first position, said inlet port is closed and said working and exhaust ports are interconnected when said control valve is in a second position, and said inlet, working and exhaust ports are closed when said control valve is in a third position.

9. The actuator of claim 8, wherein said fluid pressure control means further include a fluid circuit having a first conduit between said fluid pressure source and said inlet port of said control valve, a second conduit between said first conduit and said first cylinder and a third conduit between said working port and said second cylinder.

10. The actuator as defined in claim 9, wherein said fluid pressure control means include first and second means respectively associated with said first and third conduits for maintaining constant rates of fluid flow therein.

11. The actuator of claim 8, wherein said fluid pressure control means include servo control means for automatically moving said control valve from said first position to said second position in response to a first signal, and from said second position to said first position in response to a second signal, and first and second position sensors connected with said servo control means for sensing the positions of said first and second pistons and producing said first and second signals, respectively.

12. The actuator as defined in claim 11, wherein said first and second position sensors are adjustable to permit movement of said control valve at predetermined positions of said first and second positions, whereby the angular displacement of said output shaft may be automatically controlled.

* * * * *